US006526719B2

(12) United States Patent
Pletzer et al.

(10) Patent No.: US 6,526,719 B2
(45) Date of Patent: Mar. 4, 2003

(54) MECHANICAL PANEL CONNECTION

(75) Inventors: Stefan Pletzer, Fieberbrunn (AT); Martin Steinwender, Perchtoldsdorf (AT); Jürgen Weber, Ense (DE)

(73) Assignee: E.F.P. Floor Products GmbH, Tirol (AT)

( * ) Notice: Subject to any disclaimer, the term of this patent is extended or adjusted under 35 U.S.C. 154(b) by 0 days.

(21) Appl. No.: 09/801,258

(22) Filed: Mar. 7, 2001

(65) Prior Publication Data

US 2001/0034992 A1 Nov. 1, 2001

Related U.S. Application Data

(63) Continuation of application No. PCT/EP00/07453, filed on Aug. 1, 2000.

(30) Foreign Application Priority Data

Mar. 7, 2000 (DE) ..... 100 10 502

(51) Int. Cl.[7] ..... E04C 2/30; E04F 15/02
(52) U.S. Cl. ..... 52/592.2; 52/592.4
(58) Field of Search ..... 52/592.4, 592.2, 52/590.3, 590.2, 591.3

(56) References Cited

U.S. PATENT DOCUMENTS

| | | | |
|---|---|---|---|
| 752,694 A | 2/1904 | Lund | |
| 753,791 A | 3/1904 | Fulghum | |
| 1,124,228 A | 1/1915 | Houston | |
| 1,776,188 A | 9/1930 | Langbaum | |
| 1,986,739 A | 1/1935 | Mitte | |
| 1,988,201 A | 1/1935 | Hall | |
| 2,276,071 A | 3/1942 | Scull | |
| 2,282,559 A | 5/1942 | Byers | |
| 2,430,200 A | 4/1947 | Wilson | |
| 2,740,167 A | 4/1956 | Rowley | |
| 2,808,624 A | 10/1957 | Sullivan | |
| 3,045,294 A | 7/1962 | Livezey | |
| 3,310,919 A | 3/1967 | Bue et al. | |
| 3,535,844 A | 10/1970 | Glaros | |
| 3,538,665 A | 11/1970 | Gohner | |
| 3,694,983 A | 10/1972 | Conquet | |
| 3,859,000 A | 1/1975 | Webster | |
| 4,074,496 A | 2/1978 | Fischer | |
| 4,104,840 A | 8/1978 | Heintz et al. | 52/309.9 |
| 4,169,688 A | 10/1979 | Toshio | |
| 4,426,820 A | 1/1984 | Terbrack et al. | |
| 4,641,469 A | 2/1987 | Wood | |
| 4,769,963 A | 9/1988 | Meyerson | |

(List continued on next page.)

FOREIGN PATENT DOCUMENTS

| | | |
|---|---|---|
| CH | 513 310 | 11/1971 |
| DE | 1 212 275 | 3/1966 |
| DE | 25 02 992 | 7/1976 |

(List continued on next page.)

*Primary Examiner*—Michael Safavi
(74) *Attorney, Agent, or Firm*—Fish & Neave; Garry J. Tuma

(57) ABSTRACT

A panel connection, particularly for flooring panels, having a groove (34) that is embodied at a side edge (3); a tongue (32) that is embodied at a side edge (4); a depression (35) that is embodied in the groove (34) and has an interlocking surface (17); an interlocking element (33) that is embodied at the tongue (32) and has an interlocking surface (27); and fitting surfaces (12, 22), which are embodied in the groove (34) and at the tongue (32) and serve as abutments for the interlocking surfaces (17, 27). The properties of interlocking and orientation stability are improved in that the groove (34) has fitting surfaces (14, 15), which extend parallel to the top side (5), in the region of the groove bottom (7), and the tongue (32) has fitting surfaces (24, 25), which extend parallel to the top side (9), in the region of the end surface (8), with the fitting surfaces (14, 24; 15, 25) resting against one another in the interlocked state of the connection.

16 Claims, 2 Drawing Sheets

U.S. PATENT DOCUMENTS

| | | | | | |
|---|---|---|---|---|---|
| 4,819,932 | A | | 4/1989 | Trotter, Jr. | |
| 5,029,425 | A | | 7/1991 | Bogataj | |
| 5,165,816 | A | | 11/1992 | Parasin | |
| 5,216,861 | A | | 6/1993 | Meyerson | |
| 5,274,979 | A | | 1/1994 | Tsai | |
| 5,295,341 | A | | 3/1994 | Kajiwara | |
| 5,349,796 | A | | 9/1994 | Meyerson | |
| 5,404,686 | A | | 4/1995 | Esposito | |
| 5,502,939 | A | | 4/1996 | Zadock et al. | |
| 5,706,621 | A | | 1/1998 | Pervan | 52/403.1 |
| 5,797,237 | A | * | 8/1998 | Finkell, Jr. | 52/590.2 |
| 5,860,267 | A | | 1/1999 | Pervan | 52/748.1 |
| 6,006,486 | A | | 12/1999 | Moriau et al. | 52/589.1 |
| 6,023,907 | A | | 2/2000 | Pervan | 52/748.1 |
| 6,094,882 | A | | 8/2000 | Pervan | 52/745.19 |
| 6,101,778 | A | | 8/2000 | Mårtensson | 52/582.1 |
| 6,182,410 | B1 | | 2/2001 | Pervan | 52/403.1 |
| 6,209,278 | B1 | | 4/2001 | Tychsen | |
| 6,216,409 | B1 | * | 4/2001 | Roy et al. | 52/592.4 |
| 6,247,285 | B1 | | 6/2001 | Moebus | |
| 6,332,733 | B1 | | 12/2001 | Hamberger et al. | |
| 6,345,481 | B1 | | 2/2002 | Nelson | |

FOREIGN PATENT DOCUMENTS

| | | | |
|---|---|---|---|
| DE | 26 16 077 | | 10/1977 |
| DE | 29 17 025 | | 11/1980 |
| DE | 30 33 907 | | 5/1982 |
| DE | 30 41 781 | | 6/1982 |
| DE | 32 46 376 | | 6/1984 |
| DE | 33 43 601 | | 6/1985 |
| DE | 35 44 845 | | 6/1987 |
| DE | 41 30 115 | A1 | 3/1993 |
| DE | 42 15 273 | | 11/1993 |
| DE | 42 42 530 | | 6/1994 |
| DE | 44 00 572 | | 8/1994 |
| DE | 195 14 165 | | 3/1996 |
| DE | 195 03 948 | | 8/1996 |
| DE | 296 08 195 | | 9/1996 |
| DE | 195 11 766 | | 10/1996 |
| DE | 195 12 423 | | 10/1996 |
| DE | 295 20 966 | | 10/1996 |
| DE | 296 10 462 | | 10/1996 |
| DE | 296 19 983 | | 2/1997 |
| DE | 297 03 962 | | 6/1997 |
| DE | 297 10 175 | | 9/1997 |
| DE | 297 16 028 | | 12/1997 |
| DE | 297 19 986 | | 3/1998 |
| DE | 298 03 708 | | 7/1998 |
| DE | 197 09 641 | | 9/1998 |
| DE | 197 18 319 | | 11/1998 |
| DE | 298 15 780 | | 6/1999 |
| DE | 299 11 462 | | 12/1999 |
| DE | 298 23 749 | | 2/2000 |
| DE | 198 51 200 | | 3/2000 |
| DE | 298 22 341 | | 4/2000 |
| DE | 299 22 649 | | 4/2000 |
| DE | 200 02 413 | | 5/2000 |
| DE | 299 21 814 | | 5/2000 |
| DE | 198 51 656 | | 6/2000 |
| DE | 200 00 484 | | 6/2000 |
| DE | 200 04 359 | | 6/2000 |
| DE | 198 59 038 | | 7/2000 |
| DE | 199 01 595 | | 8/2000 |
| DE | 200 01 225 | | 8/2000 |
| DE | 200 01 788 | | 8/2000 |
| DE | 296 23 914 | | 8/2000 |
| DE | 200 05 877 | | 11/2000 |
| DE | 200 12 913 | | 11/2000 |
| DE | 200 13 380 | | 12/2000 |
| DE | 297 24 334 | | 1/2001 |
| EP | 0 196 672 | | 10/1986 |
| EP | 0 248 127 | | 12/1987 |
| EP | 0 637 659 | | 2/1995 |
| EP | 0 652 340 | | 5/1995 |
| EP | 0 665 347 | | 8/1995 |
| EP | 0 690 185 | | 1/1996 |
| EP | 0 715 037 | | 6/1996 |
| EP | 0 733 756 | | 9/1996 |
| EP | 0 790 369 | | 8/1997 |
| EP | 0 843 763 | | 5/1998 |
| EP | 0 855 482 | | 7/1998 |
| EP | 0 877 130 | | 11/1998 |
| EP | 0 906 994 | A1 | 4/1999 |
| EP | 0 969 163 | | 1/2000 |
| EP | 0 969 164 | | 1/2000 |
| EP | 0 976 889 | | 2/2000 |
| EP | 1 024 234 | | 8/2000 |
| EP | 1 026 341 | | 8/2000 |
| FR | 2 487 407 | | 1/1982 |
| FR | 2 568 295 | | 1/1986 |
| FR | 2 630 149 | | 10/1989 |
| FR | 2 691 491 | | 11/1993 |
| FR | 2 697 275 | | 4/1994 |
| GB | 424 057 | | 2/1935 |
| GB | 463 190 | | 3/1937 |
| GB | 614 394 | | 12/1948 |
| GB | 1 381 986 | | 1/1975 |
| GB | 1 430 423 | | 3/1976 |
| GB | 2 117 813 | | 10/1983 |
| GB | 2 243 381 | | 10/1991 |
| GB | 2 256 023 | | 11/1992 |
| JP | 57-119056 | | 7/1982 |
| JP | 3-107056 | | 5/1991 |
| JP | 3-169967 | | 7/1991 |
| JP | 4-297654 | | 10/1992 |
| JP | 6-146553 | | 5/1994 |
| JP | 6-200611 | | 7/1994 |
| JP | 6-320510 | | 11/1994 |
| JP | 07-180333 | | 7/1995 |
| JP | 7-180333 | | 7/1995 |
| JP | 7-292944 | | 11/1995 |
| JP | 8-109734 | | 4/1996 |
| JP | 9-13631 | | 1/1997 |
| JP | 9-256604 | | 9/1997 |
| WO | 84/02155 | | 6/1984 |
| WO | 87/07667 | | 12/1987 |
| WO | 93/13280 | | 7/1993 |
| WO | 94/01628 | | 1/1994 |
| WO | 94/04773 | | 3/1994 |
| WO | 94/26999 | | 11/1994 |
| WO | 95/06176 | | 3/1995 |
| WO | 96/06248 | | 2/1996 |
| WO | 96/18782 | | 6/1996 |
| WO | 96/23942 | | 8/1996 |
| WO | 96/27719 | | 9/1996 |
| WO | WO 96/27721 | | 9/1996 |
| WO | 96/27721 | | 9/1996 |
| WO | WO 97/47834 | | 12/1997 |
| WO | 98/21428 | | 5/1998 |
| WO | 98/22677 | | 5/1998 |
| WO | 98/24995 | | 6/1998 |
| WO | 98/40583 | | 9/1998 |
| WO | WO 98/58142 | | 12/1998 |
| WO | 99/14452 | | 3/1999 |
| WO | 99/40273 | | 8/1999 |
| WO | 99/66151 | | 12/1999 |
| WO | 99/66152 | | 12/1999 |

* cited by examiner

MECHANICAL PANEL CONNECTION

CROSS REFERENCE TO RELATED APPLICATIONS

This is a continuation of copending, commonly assigned International Patent Application No. PCT/EP00/07453, filed Aug. 1, 2000, which is incorporated by reference herein in its entirety. This also claims the benefit of German Patent Application No. 100 10 502.5, filed Mar. 7, 2000, which is also incorporated by reference herein in its entirety.

BACKGROUND OF THE INVENTION

The invention relates to a mechanical connection of sheet-type panels, as are typically used for a floor covering, such as parquet or laminate flooring, or for ceiling and wall tiling.

In all cases, the individual panels can be joined through a mechanical connection, i.e., interlocking, to form a flat surface, so the panels can be laid without adhesives or additional mechanical fastening elements, such as screws or nails. A particular advantage of this is that the panels can be laid without adhesive bonding, and can therefore be removed.

JP 3-169967 A, on which the present invention is based, describes a mechanical connection of flooring panels. Along one side edge, the panels are provided with a groove, which is formed by an upper lip and a lower lip and extends parallel to the side edge. Embodied on the opposite side edge of the same panel is a tongue, which extends parallel to this side edge. A depression having an interlocking surface that extends at an incline with respect to the top side of the panel is embodied in the groove. A corresponding interlocking element, which has an interlocking surface that extends at an incline with respect to the top side, is embodied at the tongue. Furthermore, fitting surfaces that extend parallel to the top side and serve as abutments for the interlocking surfaces of the groove depression and the interlocking element of the tongue are embodied in the groove and at the tongue, in the region of the respective side edge. In the direction parallel to the top side, the fitting surface of the groove covers the interlocking surface embodied opposite it in the groove. The same applies for the fitting surface and the interlocking surface of the tongue, because the profiles of the groove and the tongue correspond, at least in these sections. In the interlocked state of the connection, the fitting surfaces and the interlocking surfaces fit closely together in pairs in order to keep the upper surfaces of side edges 3 and 4 in contact with one another. Through the cooperation of the fitting surfaces and the interlocking surfaces, the impacting side edges of two panels rest tightly against one another, forming a virtually gap-free connection.

Further mechanical panel connections are known from the prior art disclosed in WO 94/26999, WO 96/27721, WO 97/47834 and WO 98/58142.

A common feature of the mechanical panel connections known from the prior art is that they permit a reliable mechanical interlocking in the direction parallel to the top side of the panels, yet they possess a low rigidity with respect to a rotation of the panels at the adjacent side edges.

Hence, the panels can be pivoted relative to one another fairly easily, leading to a loosening of the mechanical connection. In the prior art, this is even desirable to a certain extent for simple panel laying. On the other hand, these known panels in the prior art possess a sufficient rigidity in terms of the aforementioned tilting and pivoting of the panels relative to one another, but the panel interlocking of the connection is inadequately rigid.

The technical problem facing the invention, therefore, is to provide a mechanical connection of panels that is distinguished by improved interlocking and stability properties.

SUMMARY OF THE INVENTION

In accordance with the invention, the outlined technical problem is solved by a connection possessing the features of the preamble to claim 1, namely that the groove has fitting surfaces in the region of the groove bottom, the surfaces extending parallel to the top side, and the tongue has fitting surfaces in the region of the end surfaces, the fitting surfaces extending parallel to the top side, with the fitting surfaces resting against one another in the interlocked state of the connection.

In accordance with the invention, it has been recognized that fitting surfaces that stabilize the connection to prevent tilting of the panels toward one another are additionally disposed inside the groove for interlocking the tongue. The interlocking is thus effected by the pair of interlocking surfaces and the pair of fitting surfaces disposed in the region of the side edges and acting as abutments. Therefore, the force generated by the interlocking surfaces effectively prevents the two panels from moving apart in a plane parallel to the top sides and perpendicular to the side edges. The two panels are stabilized to prevent tilting or pivoting along the side edges in the interlocked state by the additional fitting surfaces in the region of the groove bottom or the end surface of the tongue. Thus, different fitting-surface pairs assure the interlocking, on the one hand, and the stabilization of the orientation, on the other hand, of the two panels.

A further advantage of the mechanical panel connection according to the invention is that the two functional groups for interlocking and stabilization of orientation are embodied along a tongue or a groove, so that a desired small panel thickness can be maintained in the region of laminate flooring.

In a preferred embodiment, the distance between the interlocking surface and the fitting surface in the region of the side edges is larger than the distance between the fitting surfaces in the region of the groove bottom or the end surface of the tongue. Consequently, the end of the tongue that first enters the groove at the start of the production of the mechanical connection can be easily received by the groove, because, provided that the two panels are disposed on the same surface, the tongue can penetrate the groove by a predetermined distance without encountering mechanical resistance, so as the panels are joined, the problems arising in the prior art, for example due to the joining and pivoting of the panels relative to one another, do not occur. In addition, the groove tapers from its opening to the groove bottom, or the tongue tapers from the end facing the panel to the end surface, which improves the stability of the side-edge profiles of the two panels.

Additionally, a further surface can be embodied in the groove, the surface extending at an incline with respect to the top side and connecting the depressions of oppositely-located fitting surfaces. Likewise, a surface that extends at an incline with respect to the top side can be embodied on the other side of the groove; this surface connects the interlocking surface to the fitting surface disposed in the region of the groove bottom.

It is further preferable for the end surface of the upper lip and the end surface of the lower lip, which form the groove, to be arranged in essentially one plane. In other words, the two lips extend essentially by the same distance along the side edge, so when the mechanical panel connection is produced, the force required for latching is exerted by an impact block, which rests against the upper lip and the lower lip, and has the largest-possible contact surface. This effectively prevents damage to the side edges.

It is also preferable for the upper and lower lips to be embodied in one piece with the panel. This is possible through the process of milling the profile of the groove or the tongue out of the side edge of the panel, which is advantageous from a manufacturing standpoint. Of course, it is also possible to produce the tongue, the upper lip and/or the lower lip separately and connect them to the panels for attaining the same interlocking and orientation-stabilization properties.

BRIEF DESCRIPTION OF THE DRAWINGS

The invention is described below by way of an exemplary embodiment of flooring panels, with reference to the following drawings.

DETAILED DESCRIPTION OF THE INVENTION

All of the surfaces described below extend entirely, or at least in sections, along a longitudinal or transverse edge of panels 1 and 2, which will be generally referred to hereinafter as side edges.

Figure 1:
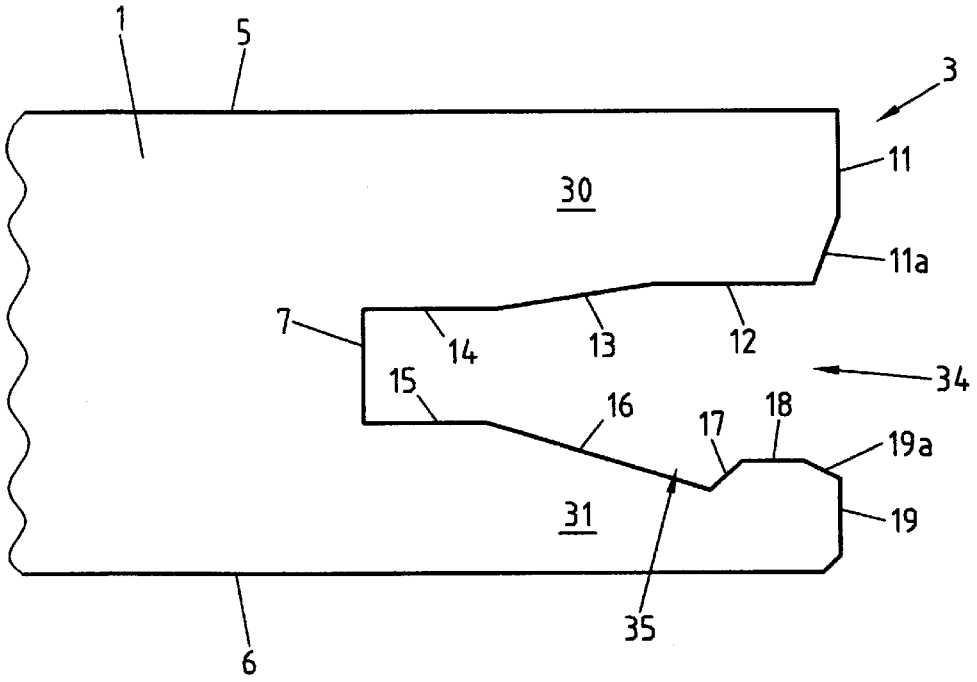
FIG. 1 shows a side edge of a panel having a groove for a connection in accordance with the invention, in a cross section.

FIG. 1 illustrates a panel 1, which has a groove 34 cut into its outside edge 3. Edge 3 has a plurality of surfaces that are inclined to various degrees relative to top side 5, and are described below.

A surface 11 is adjacent to top side 5 in the upper region of edge 3. A surface 11*a* extends in the direction of groove bottom 7, at a flat angle relative to surface 11. A surface 12 extends essentially parallel to top side 5 in the direction of groove bottom 7, when seen i s from surface 11*a*. Surfaces 13 and 14 adjoin surface 12, with surface 13 pointing downward at a flat angle, thereby connecting surfaces 12 and 14 to one another. Surface 14 is oriented parallel to top side 5 of panel 1, and ends at groove bottom 7. Thus, surfaces 12, 13 and 14 form the upper edge of groove 34 in panel 1.

Surfaces 15, 16, 17 and 18 form the lower surface of groove 34, and are oriented as follows: surface 15 extends parallel to surface 14, and is thus oriented essentially parallel to underside 6. Surface 16 adjoins surface 15, and extends downward at an incline, at a flat angle relative to surface 15. Adjoining surface 17, in contrast, is oriented upward, with the angle of ascent of surface 17 being larger than the angle of surface 16, which it forms with horizontal surface 15. Surface 18, which is oriented parallel to surface 12 and thus to top side 5 or underside 6 of panel 1, adjoins surface 17.

Surface 19 forms the lower end surface of edge 3, and is oriented essentially parallel to surface 11. Surfaces 11 and 19 are preferably disposed in one plane. Surface 19*a* forms the transition between surfaces 18 and 19, and is oriented inward at an incline.

Groove 34 of panel 1 is therefore formed by an upper lip 30 and a lower lip 31. Upper lip 30 is surrounded by surfaces 5, 11, 11*a*, 12, 13 and 14, with surface 11 forming the end surface of upper lip 30. Lower lip 31 is limited by surfaces 6, 15, 16, 17, 18, 19 and 19*a*, with surface 19 forming the end surface of lower lip 31.

Figure 2:
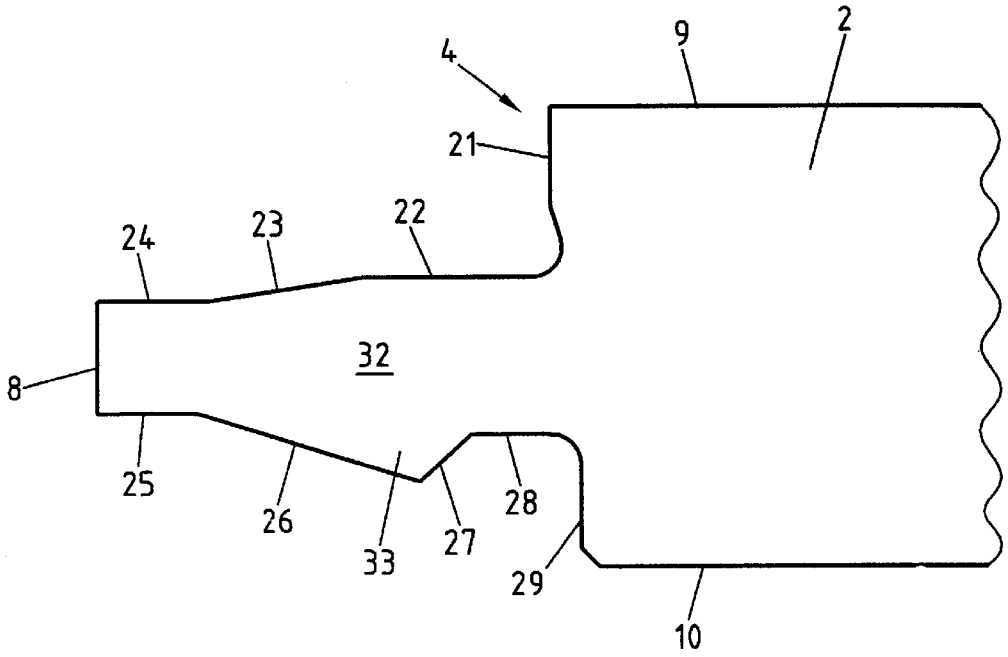
FIG. 2 shows a cross section of a side edge of a panel having a tongue for a connection in accordance with the invention, corresponding to the groove illustrated in FIG. 1.

FIG. 2 illustrates a panel 2, which has at an edge 4 a tongue 32, which is preferably an integral component of panel 2. Edge 4 has an upper surface 21, which adjoins top side 9 of panel 2. Surface 21 extends essentially vertically downward. Tongue 32 is surrounded by surfaces 22, 23, 24, 8, 25, 26, 27 and 28. Surface 22 extends essentially horizontally, and thus parallel to surface 9 of panel 2. Surface 23 is inclined downward at a flat angle, and connects surfaces 22 and 24 to one another. Surface 24 is, again, oriented parallel to top side 9 of panel 2, and thus extends essentially horizontally. Surface 24 ends at end surface 8 of tongue 32.

The lower surfaces of tongue 32 have the following orientations: surface 25 borders end surface 8, and extends parallel to surface 24, or essentially parallel to underside 10 of panel 2. Surface 26 extends downward and away from end surface 8 of tongue 32, while surface 27 is, again, oriented upward at an incline. The angle of inclination of surface 27 is larger than the angle of surface 26, which it forms with the horizontal. Surface 28 adjoins surface 27, and changes over into surface 29 of edge 4. Surface 29 extends essentially vertically, that is, perpendicular to underside 10 of panel 2. Surfaces 21 and 29 are therefore oriented essentially parallel to one another, but do not lie in one plane; surface 29 is offset slightly to the rear, in the direction of the body of panel 2, relative to surface 21.

Figure 3:
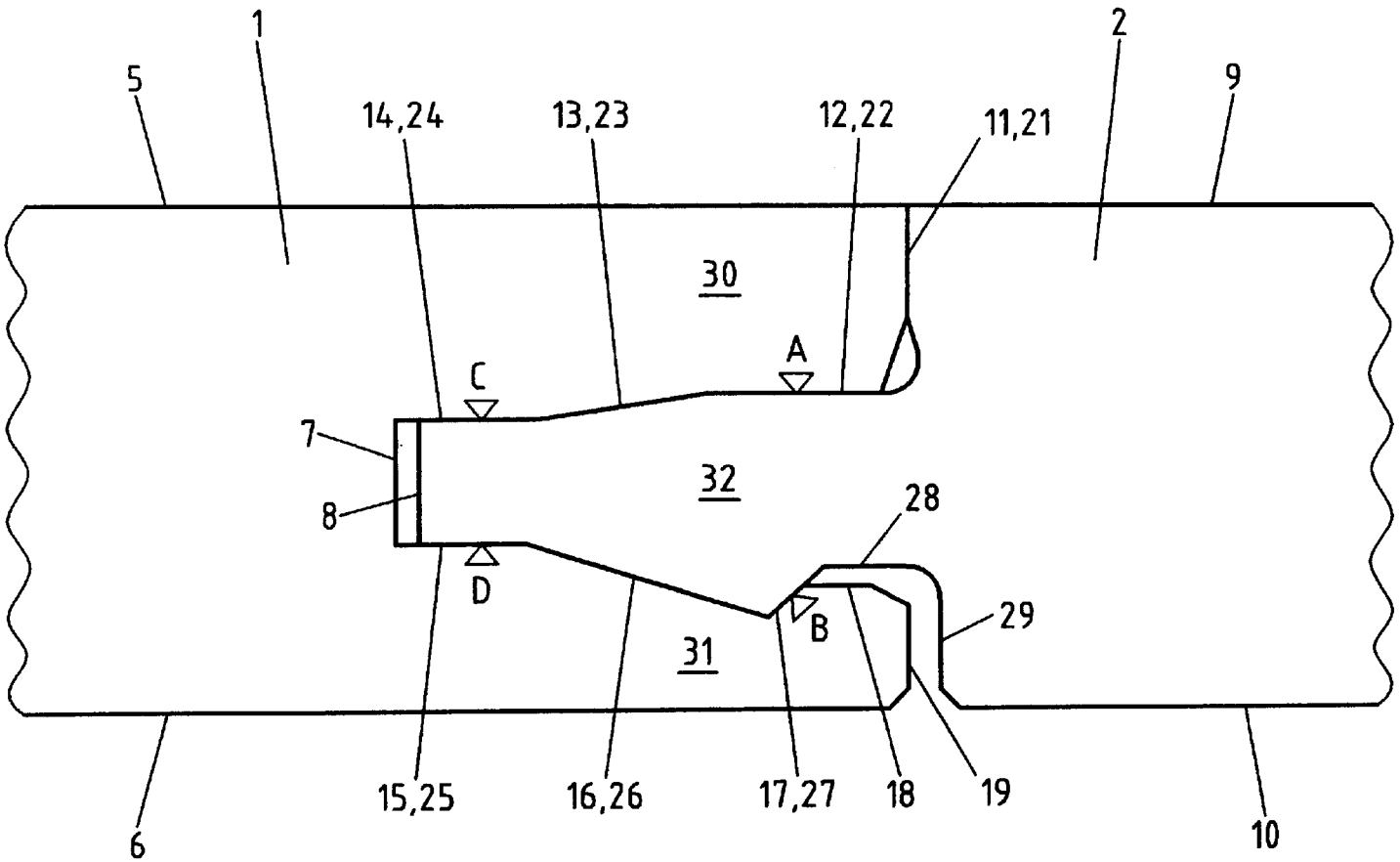
FIG. 3 shows a cross section of the profiles illustrated in FIGS. 1 and 2, in the engaged state.

FIG. 3 depicts panels 1 and 2, which are mechanically connected to one another. Tongue 32 of panel 2 engages upper lip 30 and lower lip 31 of groove 34 of panel 1.

In the latched or interlocked state, the above-described surfaces of groove 34, on the one hand, and of the tongue, on the other hand, rest against one another, at least partly in pairs, to form a flat surface. This forms at least the fitting-surface pairs 12, 22; 14, 24; 15, 25; and 17, 27 represented by the open triangles and capital letters A, B, C and D.

The two upper fitting-surface pairs 12, 22 is and 14, 24 effect a height offset of the two coupled parts, namely spring 32, on the one hand, and groove 34 formed by lips 30 and 31, on the other hand. This prevents panel 2 from tilting relative to panel 1, particularly during the joining process.

The two pairs of surfaces 12, 22 and 14, 24 have oppositely-located pairs of surfaces 15, 25 and 17, 27 as abutments. This snug fit secures the position of spring 32 at the front end facing end surface 8, as well as at the rear end facing edge 4. Surface pairs 14, 24 and 15, 25 are spaced as far as possible from surface pairs 12, 22 and 17, 27. This attains a high stability and, particularly, a high flexural strength against a stress acting vertically on surfaces 5 and 9 of coupled panels 1 and 2.

Furthermore, the above-described effects can also be enhanced and improved if surface pairs 13, 23 and 16, 26 fit snugly together, thereby improving the flexural strength.

To this point, the cooperation of the surfaces has been described in terms of flexural strength. Surfaces 17 and 27 ensure that tongue 32 is held securely in groove 34 formed by lips 30 and 31, because surfaces 26 and 27 form a downward-projecting interlocking element 33 of tongue 32, which extends into depression 35 formed by surfaces 16 and 17 in groove 34 at lower lip 31. As indicated by triangle B, surfaces 17 and 27 are inclined such that tongue 32 is effectively prevented from sliding out of groove 34.

Furthermore, groove 34 and tongue 32 are oriented so precisely to one another that, with a snug fit of tongue 32 in groove 34, surfaces 11 and 21 of edges 3 and 4 of panels 1 and 2 rest closely together. Thus, surfaces 9 and 5 rest against one another without gaps, and form a throughgoing surface.

For a joining process, panels 1 and 2 are moved toward one another horizontally, that is, essentially parallel to undersides 6 and 10. Due to a corresponding mechanical pressure, tongue 32 presses lower lip 31 downward until tongue 32 has been pushed so far into groove 34 that it latches with lower lip 31. FIG. 3 illustrates the latched state. It is emphasized here that only surfaces 11 and 21, which extend perpendicular to top sides 5 and 9, rest against one another, thereby defining the relative position of panels 1 and 2. The further vertical surface pairs 7 and 8, and 19 and 29, in contrast, have no direct mechanical contact with one another.

FIG. 3 further shows that, in the interlocked state, the two profiles form hollow spaces in the region of surfaces 11 and 21, and 7 and 8. These spaces serve to receive possible impurities, so the fit between the fitting surfaces is not impeded. The hollow spaces can also receive an adhesive, should it be necessary for fixing the assumed position. It is emphasized here, however, that no adhesive is required for the mechanical interlocking.

Panel 1 and panel 2 can be provided on all sides with either the profile shown in FIG. 1 or the profile shown in FIG. 2, so a plurality of panels 1 and 2 can be joined to create a flat arrangement. To this end, the panels have a profile in accordance with FIG. 1 on a respective longitudinal side and a respective transverse side, and a profile in accordance with FIG. 2 on the other sides.

The embodiment illustrated in FIGS. 1–3 has one-piece embodiments of groove 34 in panel 1, on the one hand, and tongue 32 in or on panel 2, on the other hand. Of course, it is also possible to embody tongue 32, lower lip 31, or both in multiple pieces, for example, through the use of plastic profiles in combination with the wood materials of the panel. The invention is therefore not limited to a one-piece embodiment.

We claim:

1. A panel connection, particularly for flooring panels, comprising:

a first panel (1) having a first side edge (3), the first side edge (3) having an upper lip (30) and a lower lip (31) forming a groove (34) that extends parallel to the first side edge (3), the groove (34) having a first surface (17) on the lower lip (31) extending at an upward incline away from the inside of groove (34) towards a first top side (5) of the first panel (3), the groove (34) also having a second surface (12) on the upper lip (30) extending substantially parallel to the first top side (5), the second surface (12) completely covering the first surface (17), the groove (34) further having a third surface (14) on the upper lip (30) and a fourth surface (15) on the lower lip (31) both extending substantially parallel to the first top side (5); and a second panel (2) having a second side edge (4) having a tongue (32) extending parallel to the second side edge (4), the tongue (32) having an interlocking element (33) embodied therein and having a fifth surface (27) extending at an upward incline toward a second top side (9) of the second panel (2), the tongue (32) also having a sixth surface (22) forming a top thereof and extending parallel to the second top side (9), the tongue (32) further having a seventh surface (24) and an eighth surface (25) both extending substantially parallel to the second top side (9) substantially near a distal end of the tongue (32);

wherein, in an interlocked state of connection:

the second and sixth surfaces (12, 22) rest against one another and the first and fifth surfaces (17, 27) rest against one another to keep a first end surface (11) of the upper lip (30) in contact with a second end surface (21) of the second side edge (4), the third and seventh surfaces (14, 24) rest against one another, and the fourth and eighth surfaces (15, 25) rest against one another.

2. The connection according to claim 1 wherein the shortest distance between the first surface (17) and the second surface (12) is larger than the spacing between the third surface (14) and the fourth surface (15).

3. The connection according to claim 2 wherein a ninth surface (13) embodied in the groove (34) and extending at an incline relative to the first top side (5) connects the second surface (12) to the third surface (14).

4. The connection according to claim 2 wherein a ninth surface (16) embodied in the groove (34) and extending at a downward incline away from the inside of the groove (34) connects the first surface (17) to the fourth surface (15).

5. The connection according to claim 2 wherein the first end surface (11) and a third end surface (19) on a distal end of the lower lip (31) are substantially aligned in the same plane.

6. The connection according to claim 2 wherein the upper lip (30) and the lower lip (31) are embodied in one piece with the first panel (1).

7. The connection according to claim 1 wherein a ninth surface (13) embodied in the groove (34) and extending at an incline relative to the first top side (5) connects the second surface (12) to the third surface (14).

8. The connection according to claim 7 wherein a tenth surface (16) embodied in the groove (34) and extending at a downward incline away from the inside of the groove (34) connects the first surface (17) to the fourth surface (15).

9. The connection according to claim 7 wherein the first end surface (11) and a third end surface (19) on a distal end of the lower lip (31) are substantially aligned in the same plane.

10. The connection according to claim 7 wherein the upper lip (30) and the lower lip (31) are embodied in one piece with the first panel (1).

11. The connection according to claim 1 wherein a ninth surface (16) embodied in the groove (34) and extending at a downward incline away from the inside of the groove (34) connects the first surface (17) to the fourth surface (15).

12. The connection according to claim 11 wherein the first end surface (11) and a third end surface (19) on a distal end of the lower lip (31) are substantially aligned in the same plane.

13. The connection according to claim 11 wherein the upper lip (30) and the lower lip (31) are embodied in one piece with the first panel (1).

14. The connection according to claim 1 wherein the first end surface (11) and a third end surface (19) on a distal end of the lower lip (31) are substantially aligned in the same plane.

15. The connection according to claim 14 wherein the upper lip (30) and the lower lip (31) are embodied in one piece with the first panel (1).

16. The connection according to claim 1 wherein the upper lip (30) and the lower lip (31) are embodied in one piece with the first panel (1).

* * * * *